United States Patent [19]

Higuchi et al.

[11] 4,210,792

[45] Jul. 1, 1980

[54] INDUCTION HEATING APPARATUS WITH LOAD DETECTING AND CONTROL CIRCUIT

[75] Inventors: Iwao Higuchi, Ayase; Takashi Fujita, Kawasaki, both of Japan

[73] Assignee: Tokyo Shibaura Electric Co., Ltd., Japan

[21] Appl. No.: 808,893

[22] Filed: Jun. 22, 1977

[30] Foreign Application Priority Data

Jul. 27, 1976 [JP] Japan ..... 51/89468
Jul. 27, 1976 [JP] Japan ..... 51/89471

[51] Int. Cl.[2] ..... H05B 5/04
[52] U.S. Cl. ..... 219/10.49 R; 219/10.77; 363/19
[58] Field of Search ..... 219/10.49, 10.77; 363/19, 85, 86, 89; 323/DIG. 1, 24, 122; 307/96, 97, 363, 247 R, 271

[56] References Cited

U.S. PATENT DOCUMENTS

| | | | |
|---|---|---|---|
| 3,530,370 | 9/1970 | Yamachi et al. | 323/122 |
| 3,596,165 | 7/1971 | Andrews | 363/19 |
| 4,016,392 | 4/1977 | Kobayashi et al. | 219/10.77 |
| 4,055,740 | 10/1977 | Nakamura et al. | 219/10.49 |
| 4,074,101 | 2/1978 | Kiuchi et al. | 219/10.77 |

*Primary Examiner*—Thomas J. Kozma
*Assistant Examiner*—Philip H. Leung
*Attorney, Agent, or Firm*—Finnegan, Henderson, Farabow, Garrett & Dunner

[57] ABSTRACT

The induction heating apparatus comprises a DC source, a series oscillation circuit including a heating coil and a capacitor connected across the DC source, a diode having an opposite polarity with respect to the polarity of the DC source and connected in parallel with the capacitor and a transistor having a collector-emitter path connected in parallel with the capacitor. The conduction state of the transistor is controlled by a control circuit responsive to the output of a current detector which detects the direction and magnitude of the current flowing through the heating coil.

1 Claim, 33 Drawing Figures

INDUCTION HEATING APPARATUS WITH LOAD DETECTING AND CONTROL CIRCUIT

BACKGROUND OF THE INVENTION

This invention relates to an induction heating apparatus.

Among the prior art induction heating devices are included a series inverter control system in which a heating coil is connected in series with a capacitor and a parallel inverter control system in which a heating coil is connected in parallel with a capacitor. In each system, high frequency sine wave current is supplied continuously or intermittently to the heating coil for inductively heating a load, for example, a cooking pan. When controlling the power supplied to the heating coil by the inverter control system power supply voltage is subjected to phase control or rectification control using a thyristor.

Furthermore, in the prior art induction heating device the power consumed by the load varies substantially in proportion to the square of the source voltage, so that the power consumption varies as the source voltage varies. Accordingly, it is necessary to use a highly stable source. Moreover, in the prior art induction heating device, since the electromagnet energy stored in the heating coil is not returned to the source, the power efficiency is poor. Under no load condition, a surge voltage several times larger than that occurring under loaded condition is produced thus damaging the control thyristors. Furthermore, since power consumption in the load is controlled by the phase control or rectification control technique apparent power component is increased thus decreasing the power efficiency. Further, since the thyristor is used as a switching element at high voltage, the rate of rise of the current when the thyristor is turned ON is high so that a radio wave interference occurs.

SUMMARY OF THE INVENTION

Accordingly, it is an object of this invention to provide a novel induction heating apparatus capable of operating at high power efficiencies and preventing large surge voltage.

According to this invention there is provided an induction heating apparatus comprising first and second DC power source terminals, a series ciruit including a heating coil and a capacitor and connected between the power source terminals, a rectifying element connected in parallel with the capacitor, switching means connected in parallel with the capacitor, means for detecting the current flowing through the heating coil, and a control circuit operated in response to the output signal from the current detecting means to control the conduction state of the switching means so that an alternating current can flow through the heating coil.

BRIEF DESCRIPTION OF THE DRAWING

Further objects and advantages of the invention can be more fully understood from the following detailed description taken in conjunction with the accompanying drawings in which:

FIGS. 3A through 3M are waveforms at certain points of the circuits shown in FIGS. 1 and 2;

DETAILED DESCRIPTION OF THE PREFERRED EMBODIMENTS

Figure 1:
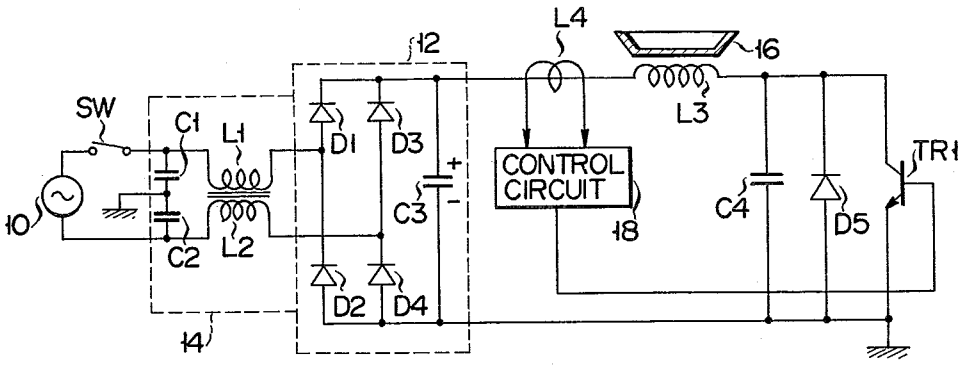
FIG. 1 is a circuit diagram of an induction heating apparatus according to one embodiment of this invention.

In the embodiment of this invention shown in FIG. 1 the voltage of an AC power source 10 is supplied to a rectifier circuit 12 through a power source switch SW and a filter circuit 14 constituted by capacitors C1 and C2 and magnetically coupled coils L1 and L2. The rectifier circuit 12 comprises a capacitor C3, a first series circuit including diodes D1 and D2 and a second series circuit including diodes D3 and D4, the series circuits being connected in parallel with the capacitor C3. The AC voltage is applied between the junctures of diodes D1 and D2 and of diodes D3 and D4, and a rectified DC voltage is generated across the capacitor C3 whose negative terminal is grounded. Across the capacitor C3 of the rectifier circuit 12 is connected a series circuit of a capacitor C4 and a heating coil L3 for heating a cooking pan 16. A diode D5 having a polarity opposite to that of the DC voltage generated by the rectifier circuit 12 is connected in parallel with the capacitor C4. Also in parallel with the capacitor C4 is connected the collector-emitter path of a transistor TR1 acting as a switching element. The base electrode of transistor TR1 is connected to a control circuit 18 which produces a control signal in response to the output current of a current detection coil L4 which detects the current flowing through the heating coil L3.

Figure 2:
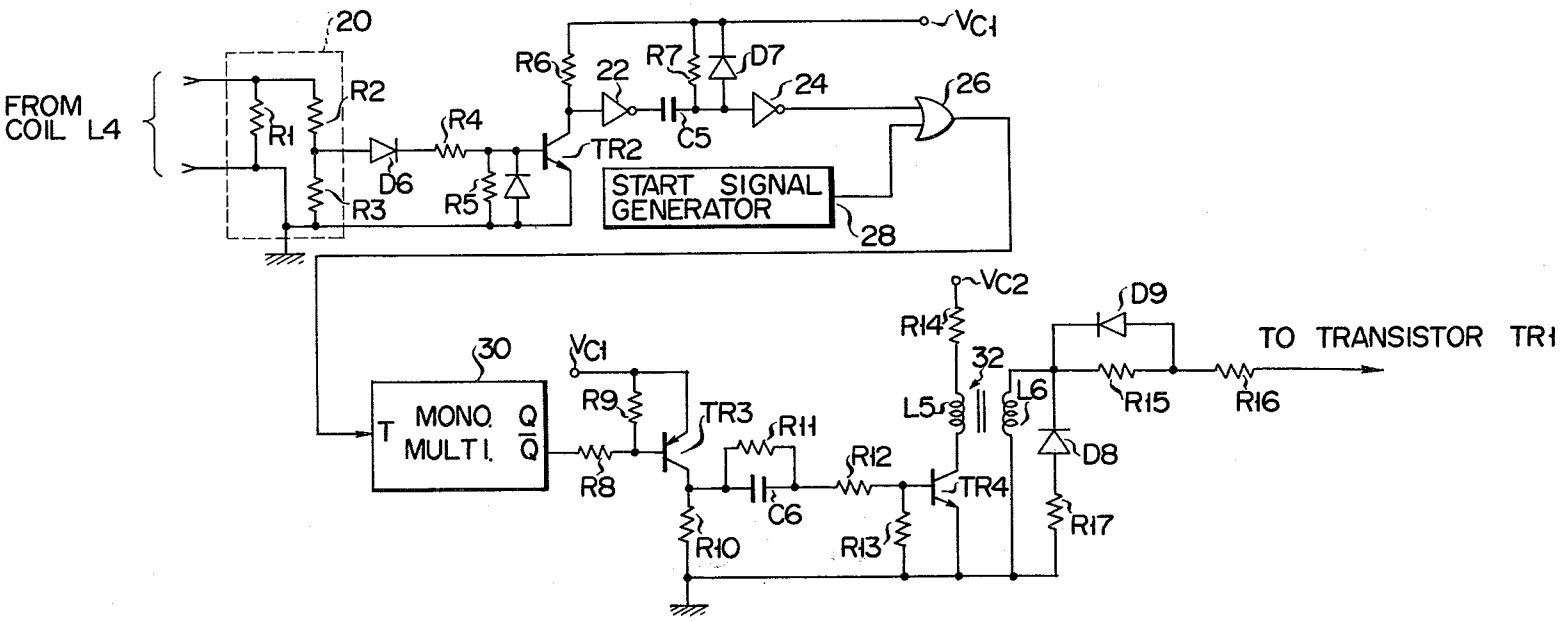
FIG. 2 is a circuit diagram showing the detail of the control circuit utilized in the induction heating apparatus shown in FIG. 1.

FIG. 2 shows one example of the control circuit 18. The current from the current detection coil L4 is supplied to a current detection circuit 20 which comprises a resistor R1 connected between the output terminals of the current detection coil L4 with one terminal grounded, and a series circuit including resistors R2 and R3 and connected in parallel with the resistor R1. The juncture between resistors R2 and R3 is connected to the base electrode of a transistor TR2 via a diode D6 and a resistor R4. The emitter electrode of this transistor TR2 is grounded so that when a positive voltage is generated across resistor R1, the transistor TR2 is turned ON by the voltage drop at the juncture between the resistors R2 and R3 and the voltage drop across diode D6 and resistor R4.

The emitter electrode of transistor TR2 is grounded while the collector electrode is connected to a power source $V_{C1}$ via resistor R6 and to an inverter 22. The output of this inverter 22 is connected to one input of an OR gate 26 via a differentiating circuit constituted by a capacitor C5 and a resistor R7, and an inverter 24. To the other input of the OR gate 26 is applied a signal from a start signal generator 28. A diode D7 is connected in parallel with the resistor R7 for the purpose of preventing the damage of the inverter 24 caused by a surge voltage generated by the differentiating circuit constituted by resistor R7 and capacitor C5.

The output terminal of the OR gate 26 is coupled to the trigger terminal T of a monostable multivibrator 30 whose O output terminal is connected to the base electrode of a transistor TR3 via a resistor R8. The base electrode is also connected to the power source $V_{C1}$ via a resistor R9 and the collector electrode is grounded via a resistor R10. The collector electrode is also connected to the base electrode of a transistor TR4 by a parallel combination of a capacitor C6 and a resistor R11. The base electrode of transistor TR4 is grounded through a resistor R13, the emitter electrode is grounded directly and the collector electrode is connected to a power source $V_{C2}$ via the primary winding L5 of a pulse transformer 32 and a resistor R14. One terminal of the secondary winding L6 of the pulse transformer 32 is grounded and the other terminal is connected to the base electrode of the transistor TR1 in the induction heating circuit shown in FIG. 1 via resistors R15 and R16. A series circuit of a resistor R17 and a diode D8 is connected across the secondary winding L6 for protecting transistor TR1 against a surge voltage generated by the secondary winding L6 and for assuring positive switching operation of transistor TR1. A diode with its cathode electrode connected to the secondary winding is connected in parallel with the resistor R15. The operation of the induction heating apparatus shown in FIGS. 1 and 2 will now be described with reference to FIGS. 3A through 3M.

Figures 3A, 3B, 3C, 3D, 3E, 3F, 3G, 3H, 3J, 3K, 3L, 3M:
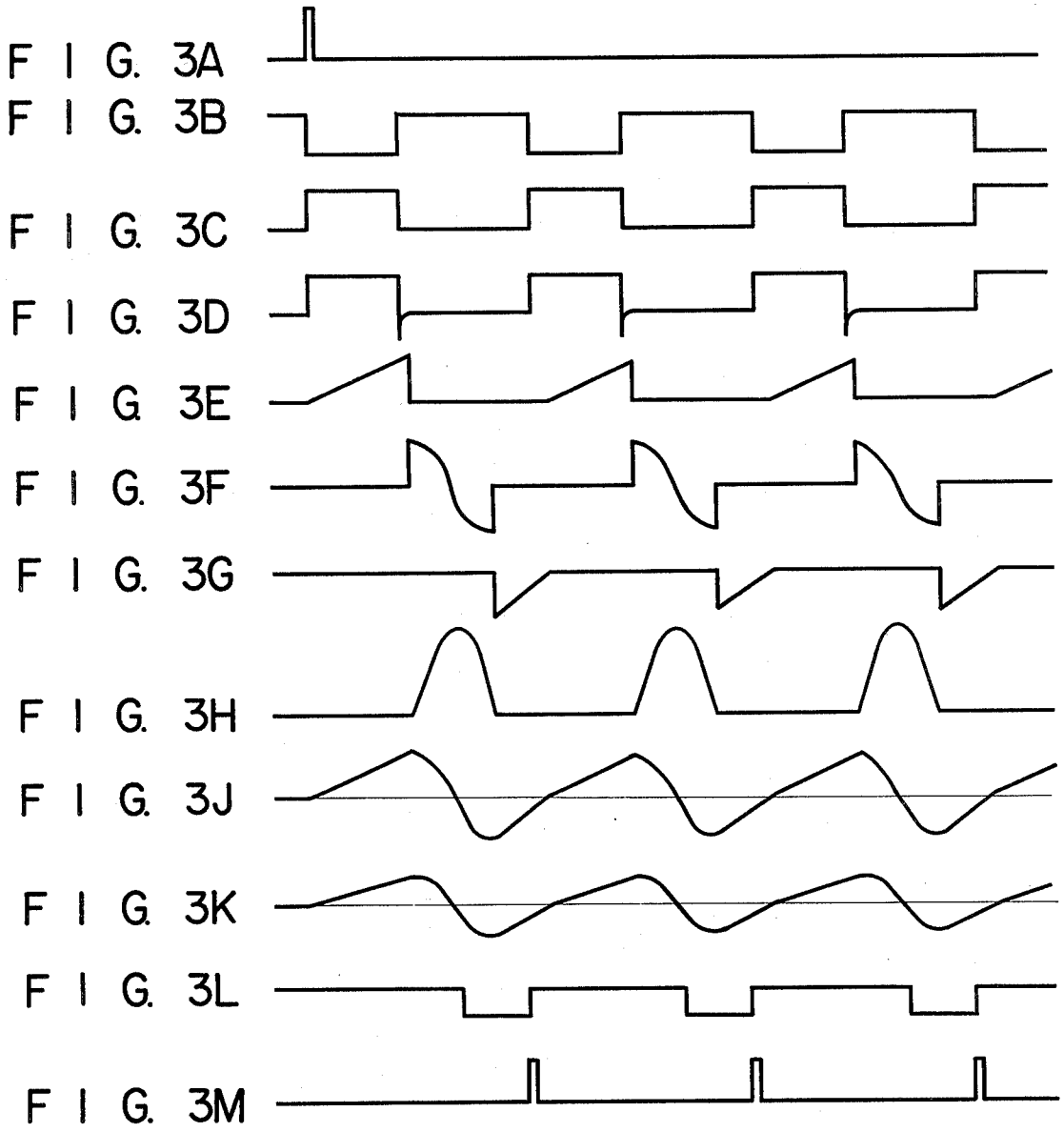

The starting signal generator 28 is interlocked with the switch SW and generates a start pulse signal as shown in FIG. 3A a predetermined time after closure of switch SW. This start pulse signal is applied to the trigger terminal of the monostable multivibrator 30 via the OR gate 26 thereby setting the monostable multivibrator 30. Then, the output from its $\overline{O}$ output terminal has a low level as shown in FIG. 3B thus turning ON the transistor TR3. Accordingly, the collector voltage of this transistor assumes a high level as shown in FIG. 3C. This high level collector voltage is applied to the base electrode of transistor TR4 to turn ON the same, with the result that current flows through the primary winding L5 of the pulse transformer 32. Then, a current as shown in FIG. 3D flows through the secondary winding L6 and voltage corresponding to this current is impressed upon the base electrode of transistor TR1 thus turning ON the same.

When transistor TR1 is turned ON, the terminal voltage across capacitor C3 of the rectifying circuit permits current to flow through the heating coil L3 and transistor TR1. As shown in FIG. 3E, this current increases linearly at a rate of E/L3 where E represents the output voltage of the rectifying circuit and L3 represents the inductance of the coil L3. The current flowing through the heating coil L3 is detected by the current detection coil L4 to produce a voltage across the resistor R1 shown in FIG. 3K and corresponding to the current flowing through the heating coil L3.

The monostable multivibrator 30 triggered by the output signal of the start signal generator 28 resets automatically after lapse of a predetermined time TO. Consequently, transistors TR3 and TR4 become nonconductive. Then, the magnetic energy stored in the heating coil L3 causes current to flow through the capacitor C4 thus charging the same. When the electromagnetic energy is disipated, the energy stored in the capacitor C4 permits current to flow through the heating coil L3. In this manner, an oscillating current as shown in FIG. 3F flows through the heating coil. At this time, the terminal voltage across te capacitor C4, that is, the collector-emitter voltage of transistor TR1 varies as shown in FIG. 3H. Thereafter, the electromagnetic energy stored in the heating coil passes current through the capacitor C3 and diode D5. Accordingly, a current as shown in FIG. 3J flows through the heating coil L3.

When the current passed through the heating coil by the energy charged in the capacitor C4 reaches a predetermined value or when a predetermined positive voltage appears across the resistor R1 the transistor TR2 is turned ON by the voltage divided by the resistors R2 and R3. Consequently, the collector voltage of the transistor TR2 changes to a low level as shown in FIG. 3L. Thereafter, when the current flowing through the heating coil L3 and the diode D5 decreses to a predetermined value, the transistor TR2 is turned OFF again. At this time, the trailing edge of the collector voltage of transistor TR2 is differentiated by the differentiating circuit constituted by the resistor R7 and capacitor C5 so that inverter 24 produces a pulse signal as shown in FIG. 3M. This pulse signal is applied to the trigger terminal T of the monostable multivibrator 30 via the OR gate 26, thus setting the monostable multivibrator 30. Thereafter, the operation described above is repeated.

Depending upon the size, material and the positional condition of the article 16 to be heated, the inductance of the heating coil L3 varies about 30 to 40%, for example, whereby the frequency of the current flowing through the heating coil is influenced. In this embodiment, since the frequency is controlled by using a monostable multivibrator it is possible to maintain the frequency of the current flowing through the heating coil at a relatively constant value when compared with a prior art control circuit. When the current flowing through the diode D5 shown in FIG. 3G reaches a predetermined value, the monostable multivibrator 30 is reset by the pulse (FIG. 3M) supplied from inverter 24 via the OR gate 26 so that smooth and continuous load current flows through the heating coil L3. Since the conduction state of the transistor TR1 is controlled by the monostable multivibrator 30 so that it conducts for a predetermined interval after the current flowing through the diode D5 has reached a predetermined value thereby setting the monostable multivibrator, transistor TR1 is maintained in the OFF state while the oscillating current flows through the heating coil L3 and the capacitor C4. For this reason, there is no fear of damaging the transistor TR1 by the discharge current of capacitor C4.

In the above described embodiment, since the induction heating circuit is constructed such that the load current is passed through the diode D5 and the heating coil L3 by the electromagnetic energy stored in the heating coil the power efficiency is high. Under no load condition, a surge voltage several times higher than the surge voltage under the normal operating condition is generated, but according to this invention, the surge voltage under no load condition is limited to from 1.1 to 1.3 times the surge voltage under the normal operating condition.

Figure 4:
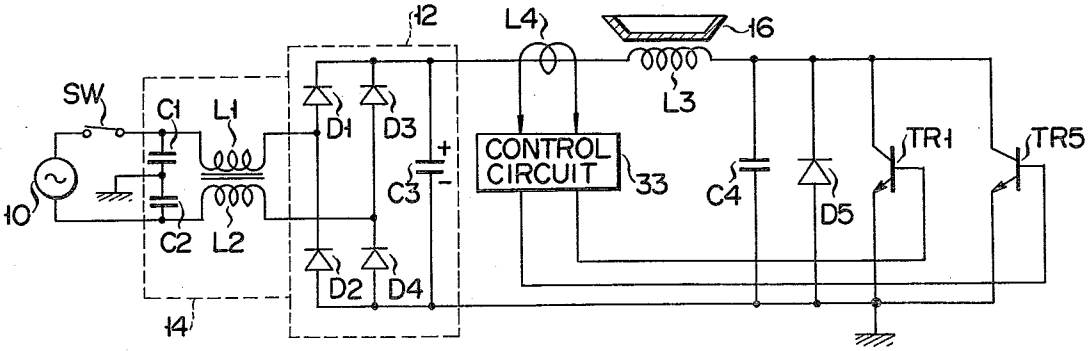
FIG. 4 is a circuit diagram showing a modified embodiment of this invention.
Figure 5:
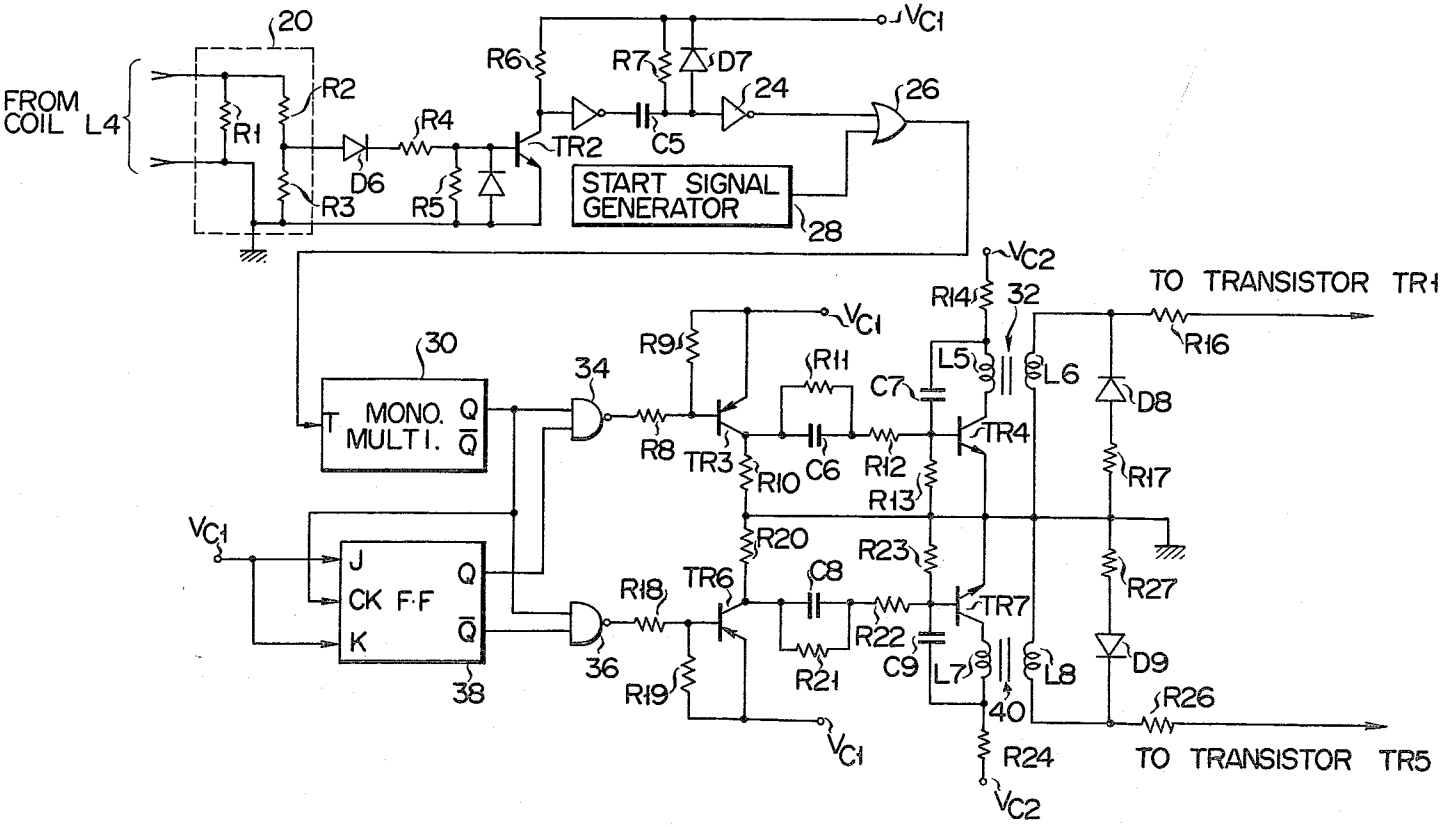
FIG. 5 is a circuit diagram showing the detail of the control circuit utilized in the induction heating apparatus shown in FIG. 4.

FIG. 4 shows a modified induction heating device of this invention which is identical to that shown in FIG. 1 except that a transistor TR5 having an emitter-collector path connected in parallel with the capacitor C4 is provided and that the conduction states of the transistors TR1 and TR5 are controlled by the control circuit 33, the detail thereof being shown in FIG. 5. In FIGS.

4 and 5 circuit elements corresponding to those shown in FIGS. 1 and 2 are designated by the same reference characters.

In this modification the O output terminal of the monostable multivibrator 30 is connected to respective inputs of NAND gates 34 and 36 to the clock terminal CK of a flip-flop circuit 38. The J and K input terminals of this flip-flop circuit are jointly connected to a source $V_{C1}$ and the output state is reversed when a clock signal is applied.

The other input of the NAND gate 34 is connected to the $\overline{O}$ output terminal of the flip-flop circuit 38, and the output of the NAND gate 34 is applied to the base electrode of the transistor TR3 via a resistor R8. The collector electrode of this transistor TR3 is coupled to the base electrode of the transistor TR4 via a parallel combination of a capacitor C6 and a resistor R11, and a resistor R12. The base electrode of transistor TR4 is connected to the juncture between the primary winding L5 of the pulse transformer 32 and the resistor R14 via a capacitor C7. The secondary winding L6 of the pulse transformer is connected to the base electrode of transistor TR1 via resistor R16.

The other input terminal of the NAND gate 36 is connected to the O output terminal of the flip-flop circuit 38 and the output of this NAND gate 36 is connected to the base electrode of a transistor TR6 via a resistor R18. The base electrode of transistor TR6 is connected to the source $V_{C1}$ via a resistor R19 and the collector electrode is grounded through a resistor R20. Thus, the transistor TR6 operates in the same manner as the transistor TR3. Furthermore, the collector electrode of transistor TR6 is coupled to the base electrode of a transistor TR7 via a parallel combination of a capacitor C8 and a resistor R21, and a resistor R22. The collector electrode of transistor TR7 is connected to a source $V_{C2}$ via the primary winding L7 of a pulse transformer 40 and a resistor R24. The emitter electrode is grounded and the base electrode is grounded via a resistor R23 and further connected to the juncture between the primary winding L7 of the pulse transformer 40 and the resistor R24 via capacitor C9. Thus, transistor TR7 operates in the same manner as transistor TR4. One terminal of the secondary winding L8 is grounded while the other terminal is connected to the base electrode of transistor TR5 via a resistor R26. A series circuit including a resistor R27 and a diode D9 is connected across the secondary winding L8.

The operation of the modification shown in FIGS. 4 and 5 will now be described with reference to FIGS. 6A through 6P.

Prior to the closure of switch SW, the J-K flip-flop circuit 38 is reset. After closing the switch SW, when a start signal generated by the start signal generator 28 and shown by FIG. 6A is applied to the trigger terminal T of the monostable multivibrator 30 via the OR gate 26, the monostable multivibrator is set. Then, the output from the O output terminal of the monostable multivibrator 30 is at a high level as shown in FIG. 6B and is utilized to set the J-K flip-flop circuit 38 thus producing a high level signal as shown in FIG. 6C from its O output terminal.

Figures 6A, 6B, 6C, 6D, 6E, 6F, 6G, 6H, 6J, 6K, 6L, 6M, 6N, 6P:
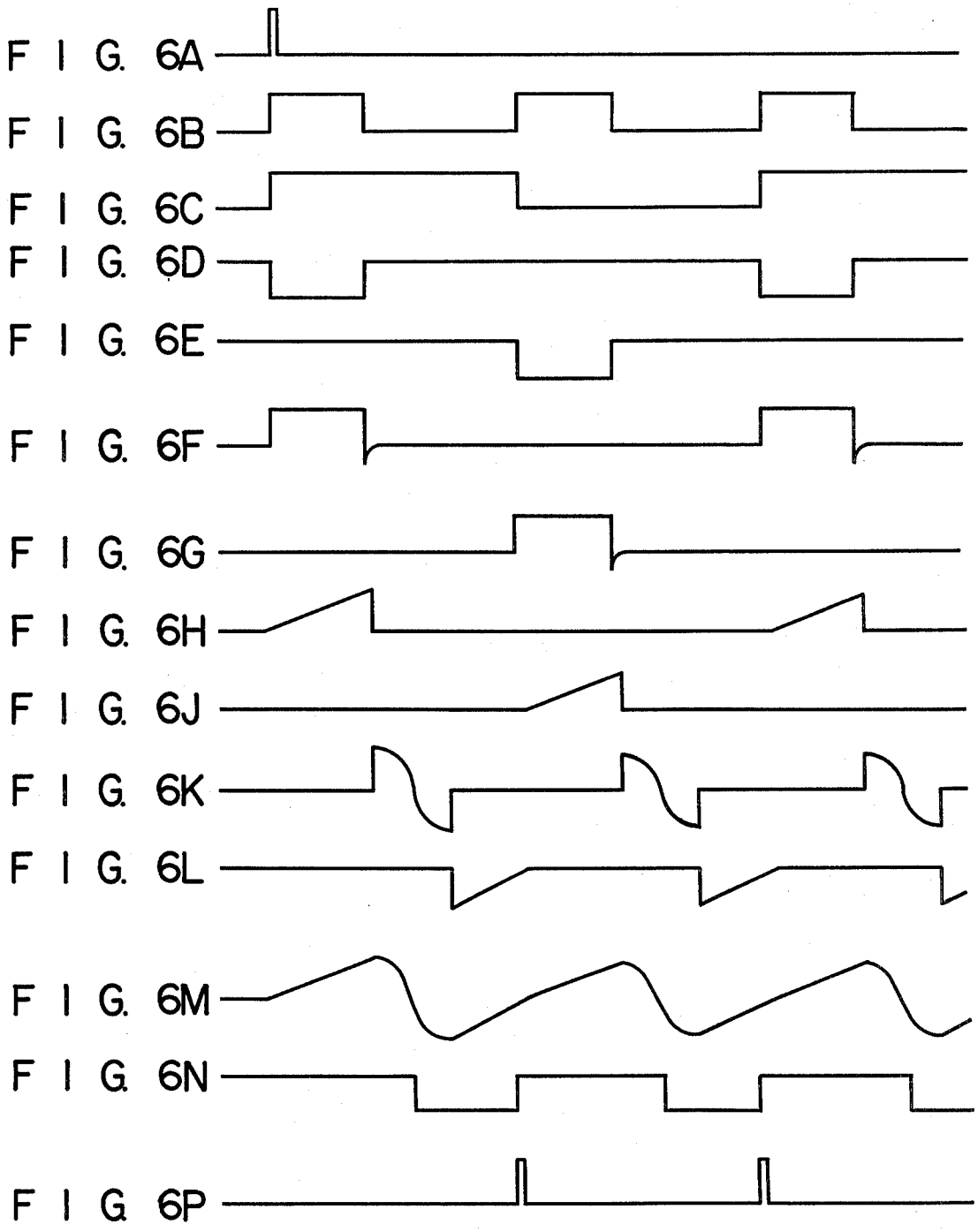
FIGS. 6A through 6P are waveforms at certain points of the circuits shown in FIGS. 4 and 5.

At this time, the NAND gate 34 is applied with high level signals from the monostable multivibrator 30 and the flip-flop circuit 38 to produce a low level output signal as shown in FIG. 6D thus turning ON the transistor TR3. Accordingly, the collector voltage of transistor TR3 rises and the transistor TR4 is turned ON. Consequently, current flows through the primary winding L5 of the pulse transformer for a short time so that a low level output pulse as shown in FIG. 6F is applied to the base electrode of transistor TR1 from the secondary winding L6 via resistor R16 thus turning ON this transistor.

Then current which increases linearly as shown in FIG. 6H flows through the heating coil L3 and the transistor TR1 in a manner described in connection with the first embodiment. The monostable multivibrator 30 resets automatically a predetermined time after it has been set, thereby producing a low level signal as shown in FIG. 6B on its O output terminal. While the monostable multivibrator 30 is being reset, an oscillation current as shown in FIG. 6K flows through the heating coil L3 and capacitor C4 in the same manner as the first embodiment. At the same time, a diode current as shown in FIG. 6L flows through the diode D5 and the heating coil L3. When the oscillation current reaches a predetermined value so that the current flowing through the heating coil L3 from the capacitor C4 creates a predetermined positive voltage across resistor R1, the voltage divided by resistors R2 and R3 turns ON transistor TR2. When the diode current decreases to said predetermined value transistor TR2 is turned OFF. Consequently, the collector voltage of this transistor varies as shown in FIG. 6N and when its collector voltage changes to the high level from the low level, a pulse as shown in FIG. 6P is generated by inverter 24 which is applied to the trigger terminal T of the monostable multivibrator 30 via the OR gate 26. Consequently, a high level output signal as shown in FIG. 6B is produced again on the O output terminal of the monostable multivibrator 30. By this high level output signal, the state of the flip-flop circuit 38 is reversed thereby producing a low level output signal from its O output terminal as shown in FIG. 6C.

At this time, the NAND gate 36 is supplied with high level signals from the O output terminal of the monostable multivibrator 30 and the $\overline{O}$ output terminal of the flip-flop circuit 38 and applies a low level output signal as shown in FIG. 6E to the base electrode of transistor TR6 via resistor R18 thus turning ON the same. Accordingly, the collector voltage of transistor TR6 becomes a high level thereby turning ON transistor TR7, with the result that current flows through transistor TR7 and the primary winding L7 of the pulse transformer 40 for a short time. Consequently, the secondary winding L8 of the pulse transformer applies a high level voltage as shown in FIG. 6G to the base electrode of transistor TR5 thus turning ON the same.

When transistor TR5 is turned ON, a current which increases linearly as shown in FIG. 6J flows through the heating coil L3 and transistor TR5. As has been pointed out hereinabove this current continues to increase until the monostable multivibrator 30 automatically resets. While the monostable multivibrator 30 is being reset, an oscillation current as shown in FIG. 6K flows through the heating coil L3 and capacitor C4 and a diode current as shown in FIG. 6L flows through the diode D5 and the heating coil L3. As above described when the oscillation current reaches a predetermined value transistor TR2 is turned ON, and when the diode current decreases to the predetermined value, transistor TR2 is turned OFF. When the collector voltage of transistor TR2 varies from the low level to the high level, a pulse as shown in FIG. 6P is generated by inverter 24 which is applied to the trigger terminal T of the monostable multivibrator 30 thus setting the same. Thereafter, the operation described above is repeated so that current as shown in FIG. 6M flows through the heating coil thus inductively heating article 16.

In this embodiment, since the conduction state of transistors TR1 and TR5 is controlled alternately in accordance with the condition of the output of the flip-flop circuit 38 it is possible to select a higher operating frequency than the embodiment shown in FIG. 1.

Although the invention has been described in terms of some preferred embodiments it should be understood that the invention is by no means limited to these specific embodiments. For example, instead of using a transistor as a switching element, it is also possible to use a gate turn off transistor or a field effect transistor.

What we claim is:

1. An induction heating apparatus comprising first and second DC power source terminals, electric energy storing means connected between said first and second DC power source terminals, a series circuit including a heating coil and a capacitor connected across said power source terminals, a rectifying element connected in parallel with said capacitor and in reverse direction with respect to said DC power source terminals, first and second switching means connected in parallel with said capacitor, means for detecting the current flowing through said heating coil, and a control circuit comprised of a pulse generator which is connected to said current detecting means for generating a pulse when said current detecting means detects that the current flowing through the heating coil and the rectifier element in the forward direction reaches a predetermined value, a monostable multivibrator circuit triggered by the output pulse from said pulse generator, a bistable multivibrator circuit whose output state is reversed in response to the output signal from said monostable multivibrator circuit, a first energizing signal generating circuit responsive to the output signals from said monostable multivibrator circuit and said bistable multivibrator circuit for applying an output signal to said first switching means when both of said monostable multivibrator circuit and said bistable multivibrator circuit are set, and a second energizing signal generating circuit responsive to the output signal of said monostable multivibrator circuit and the invention of the output signal of said bistable multivibrator circuit for applying an output signal to said second switching means when said monostable multivibrator circuit is set and said bistable multivibrator circuit is reset.

* * * * *